US005341546A

United States Patent [19]

Burke

[11] Patent Number: 5,341,546

[45] Date of Patent: Aug. 30, 1994

[54] SEAT BELT BUCKLE

[75] Inventor: David Burke, Stanwix, England

[73] Assignee: AlliedSignal Inc., Morristown, N.J.

[21] Appl. No.: 26,335

[22] Filed: Mar. 4, 1993

[30] Foreign Application Priority Data

Mar. 5, 1992 [GB] United Kingdom ..... 9204793

[51] Int. Cl.[5] ..... A44B 11/00

[52] U.S. Cl. ..... 24/641; 24/645

[58] Field of Search ..... 24/641, 640, 645, 646, 24/633, 636, 637, 638; 297/468

[56] References Cited

U.S. PATENT DOCUMENTS

| | | | |
|---|---|---|---|
| 4,451,958 | 6/1984 | Robben et al. | 24/641 |
| 4,454,634 | 6/1984 | Haglund et al. | 24/645 |
| 4,703,542 | 11/1987 | Hirata et al. | 24/641 |
| 5,014,401 | 5/1991 | Kitabawa | 24/633 |

FOREIGN PATENT DOCUMENTS

| | | | |
|---|---|---|---|
| 0384703 | 8/1990 | European Pat. Off. | 24/641 |

*Primary Examiner*—Victor N. Sakran
*Attorney, Agent, or Firm*—Markell Seitzman

[57] ABSTRACT

A vehicle seat belt buckle mechanism designed for use with belt pretensioning means and being rendered immune to the effects of rapid buckle deceleration following pretensioning action the mechanism having a resiliently movable plate 82 carried by the buckle release button, the resilience being effectively much lighter than release button return springs 49*c* so that although the plate 82 normally has no effect, in the event of pretensioning action, it slides into an abutting position in the mechanism to inhibit subsequent spurious release resulting from button movement in a crash situation.

11 Claims, 3 Drawing Sheets

SEAT BELT BUCKLE

Figure 1:
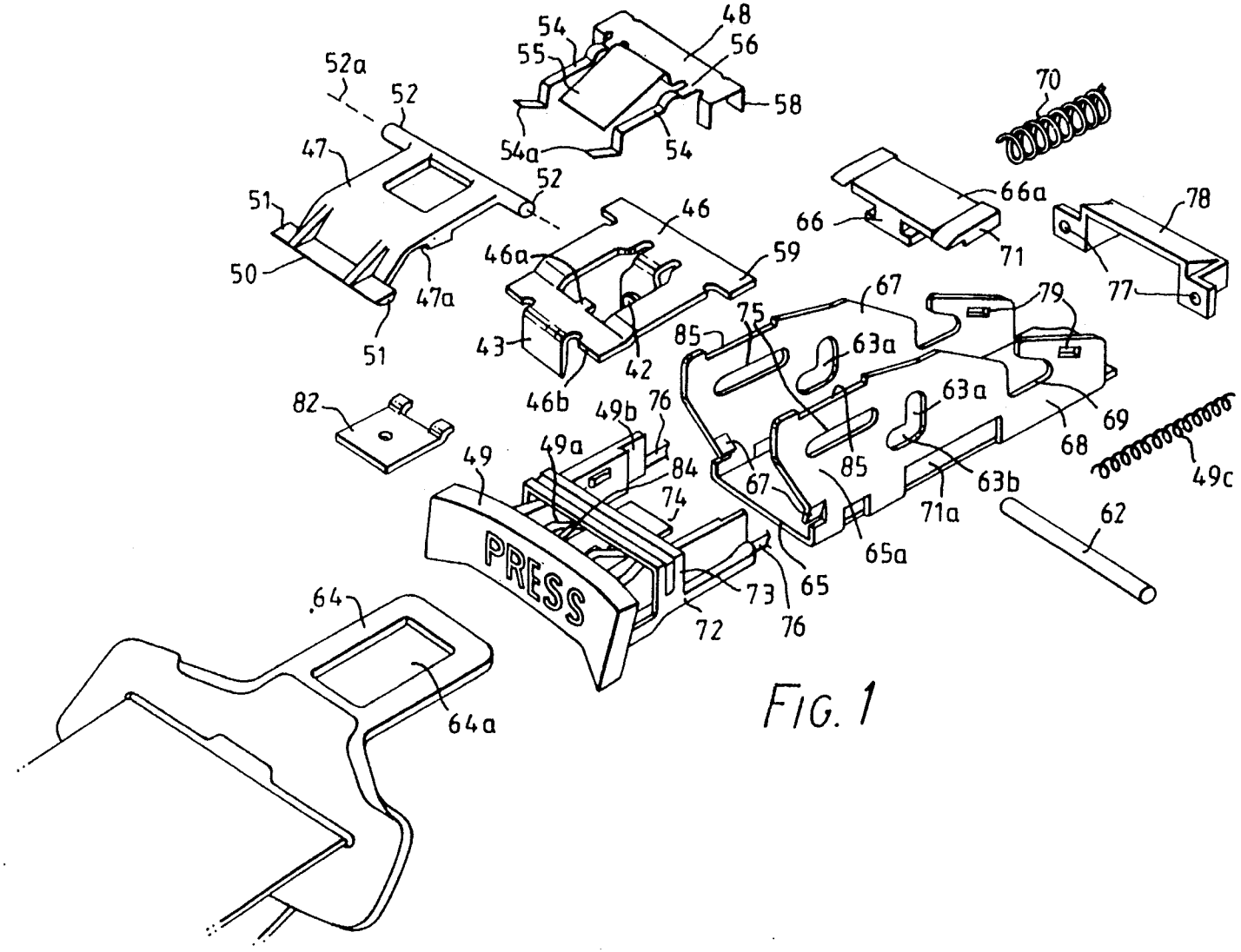

In the Specification of European Patent Application Number 90301802.66, there is described a seat belt buckle which comprises a generally U-shaped frame, presenting an opening at one end for receiving a tongue between two side portions and generally parallel to a base portion, said tongue being engageable with a spring loaded ejector, a locking element having means at one end engaging the side portions to be tiltable therebetween whereby a projection of said element is movable into or out of locking relationship with said tongue and a retaining member movable into or out of a locking position wherein it prevents movement of the projection away from said locking relationship and said retaining member being movable by the action of a release button to permit release of the tongue. In addition a spring loaded and inertially over-balanced rocking member is pivotally located by said tiltable rocking element so that spring loading of said rocking member acts in a sense to urge the rocking member into a position to constrain the retaining member to said locking position thereof and a release button has means operable to move the rocking member against its spring loading and permit displacement of the retaining member from its locking position. However, even with such an inertially over-balanced rocking member, which itself is immune to buckling deceleration, it is found that spurious release of the buckle can result from the action of a pretensioner included in a buckle anchorage means.

An object of the present invention is to provide an improved seat belt buckle wherein the tendency to such spurious release is reduced or substantially overcome.

According to the present invention there is provided a seat belt buckle mechanism which comprises a generally U-shaped frame, presenting an opening at one end for receiving a tongue along a path between two side portions and generally parallel to a base portion said tongue being engageable with a spring-loaded ejector, a locking element having means at one end engaging the side portions to be tiltable therebetween whereby a projection of said element is movable into or out of locking relationship with said tongue and a retaining member movable into or out of a locking position wherein it prevents movement of the projection away from said locking relationship and said retaining member being movable by the action of a release member to permit release of the tongue characterised by protection means operable to inhibit the action of the release member in the event of predetermined excessive rate of change of speed of the buckle in a direction tending to cause spurious release by the release member.

Preferably the protection means comprises a protection member movable relative to the frame between a non-protection position wherein it has no effect on the locking element and a protection position wherein it inhibits movement of the locking element said protection member and said release member being so resiliently biased as to cause said protection member to move to said protection position in advance of action of the release member.

Said protection member is preferable resiliently positioned and slideably carried by said release member.

In order that the invention may be more clearly understood and readily carried into effect, the same will be further described by way of example with reference to the accompanying drawing of which FIG. 1, illustrates in broken down form components of a seat belt buckle of a type to which the invention is applied and FIGS. 2–6, illustrate diagrammatic part-sectioned views of a seat belt buckle in accordance with the invention, in successive stages of its operation.

Refereeing to FIG. 1 of the drawings, the buckle comprises a generally U-shaped pressed steel frame comprising side walls 67 and 68 joined by a base portion 65. The right-hand end of the frame is provided with anchorage means (not shown) whereby it is anchored to a main structure, namely the bodywork or chassis of the vehicle to which it is fitted. The anchorage means may include a pretensioner device which is sensitive to vehicle deceleration to rapidly shorten the anchorage by a predetermined amount to tighten the attached seat belt. The left hand end of the frame presents an aperture to receive a buckling tongue 64 of a seat belt, this aperture being provided between the base portion 65 and inward projecting tongue-guide pips **67*a* of the side walls. The left hand end of the frame also receives a moulded plastic buckle tongue release button member 49 to be described in greater detail below and pips 67*a* guide the insertion of the belt tongue 64** and ensure that the tongue does not impede the action of the release button in use.

The side walls are each provided with longitudinal slots 75, L-shaped slots 63, further shaped slots 69 and a longitudinal slot **71*a* adjacent the base portion 65. A tiltable locking element 46 for the inserted tongue has downward projections 42 and 43 the latter of which projects in its locking position through an aperture 64*a* of the belt tongue and through an aperture 65*a* of the base portion. Further, the locking element 46 has lateral projections 50 which along with tabs 58 (to be further referred to) locate in the shaped slots 69** to provide a requisite pivotal action between the side frames between tongue locking and tongue unlocking positions.

The locking element 46 is shaped as shown in the drawing of FIG. 1 and supports a leaf spring element 48 by means of the aforementioned tabs 58. This spring element is formed with shaped spring leaves 54 and 55 of which leaves 54 serve to pivotally locate lateral pivot pins 52 and spring-load a rocking member 47 carried on the upper surface of FIG. 2. The rocking member is formed with an abutment surface **47*a* which in the tongue locking position of the locking element, abuts a retaining pin 62 when positioned at the left hand end 63*b* of the L-shaped slots 63. In such position the retaining pin 62, which is continuously resiliently acted upon by end parts 54*a* of spring leaves 54, serves to prevent the locking element 46 being pivoted towards its tongue releasing position. Additionally, the rocking member 47 is formed with an end 50 having ears 51 engageable by a release button member 49** described below.

The buckle mechanism assembly also includes a spring-loaded tongue ejector denoted by reference 66, having lateral wings 71 slideable within the slots **71*a* of the side walls, the ejector spring acting between the ejector 66 and the downward projection 42** in a sense to produce a net downward resilient bias on the locking element towards its tongue locking position.

Referring now to the moulded plastics buckle release button member 49, this has side rails 72 spurred by a snap-on moulded bridge 73 and slideable along the exterior of the frame sides 67. Abutments **49*b* are engageable with pin 62 and cam surfaces 49*a* are engageable with ends 51 of the rocker member 47 and subsequently with facing edges 46b of the locking element 46. Also shown in FIG. 1 are inward projections which are also provided in the side rails 72 to snap into slots 75 to be slidingly movable within the button guide slots 75, the bridge piece 73 being accommodated in recesses 85 of the outer edges of the frame side walls. The release button also has coil spring elements such as 49c one on each side. These springs are carried on projecting pins 76 which slidingly project into apertures 77 carried by a snap-on piece 78, located by indents 79 of the frame sides. Springs 49c** are therefore under compression and urge the release button leftwards.

Figure 2:
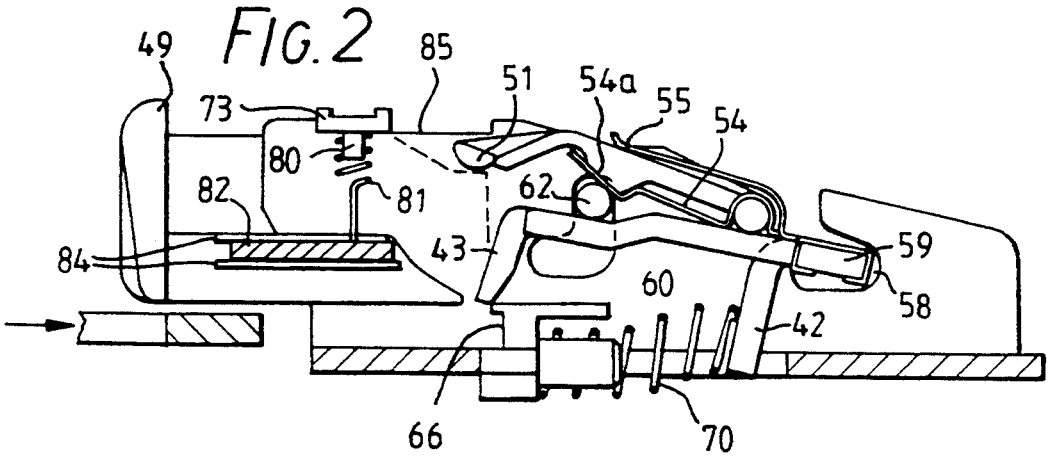
Figure 4:
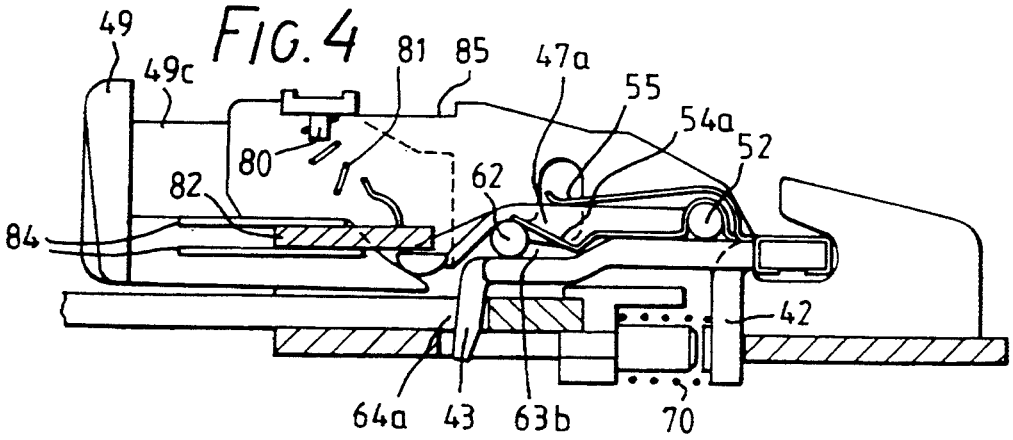
Figure 5:
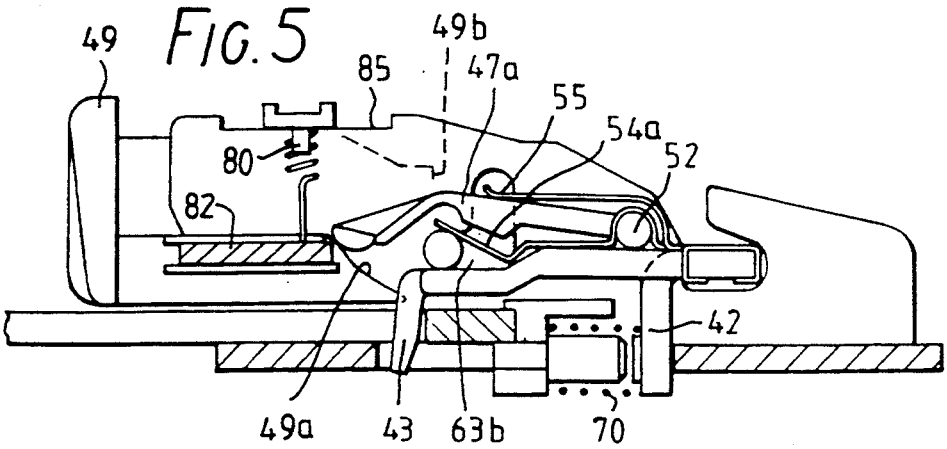

The bridge piece 73 carries a centrally disposed downwardly extending spigot 80, best seen in FIG. 2, which firmly locates the upper coiled end of a light spring 81 the lower end of which engages a rectangular metal plate 82 which is slideable in rails 84, provided on the inward facing side-surfaces 83 of the cam parts 49a. In the normal state of affairs the plate 82 is retained in the position shown in FIG. 2 and urged lightly leftwards relative to the button 49 by means of the spring 81. However, the spring 81 is very light in relation to springs 49c and in the event of a predetermined component of deceleration acting on the buckle the plate 82 is temporarily slideable, relative to the buckle release button 49, to a position such as shown in FIG. 4 in advance of significant deflection of the coil springs 49c by the inertia of the button 49. In the latter position it is seen that the plate overlays the end 50 of element 42 between the ears 51.

The buckle mechanism is assembled by first inserting the ejector and then mounting thereto together with spring 70, the sub-assembly of lock plate, unitary leaf springs element 48, and rocker 47. Insertion of the overlocking or retaining pin 62 via the L-shaped slots 63a then serves to constrain the lock bar sub-assembly in the frame 65 prior to the mounting thereto of the release button. The release button with the already-inserted plate 82 and spring 81 is snapped into place with the mentioned inward projections located in slots 75 and bridge piece 73 already located.

The operation of the assembled mechanism is best to be understood by reference to successive FIGS. 2 to 6. FIG. 2 shows the buckle in a released condition, ready to receive the tongue 64. The locking plate 46 and the overlaying rocker member 42 (having the spring element 48 retained by tabs 58 wrapped around lateral projection 59) are held in the unlocked condition shown by the projection 43 resting against the tongue ejector 66 in its fully extended position with the ejector spring 70 in its most expanded state. The force of spring 70 results in a continuous net force acting on the lock plate 46 towards its tongue locking position. The spring leaf 55 rests against the rocker 47 in a sense pivotally urging the rocker towards the lock plate and the spring leaves 54 rest against retaining pin 62, which at this time is in its non-locking position within L-shaped cut-outs 63 of the side portions 67 and 68.

Figure 3:
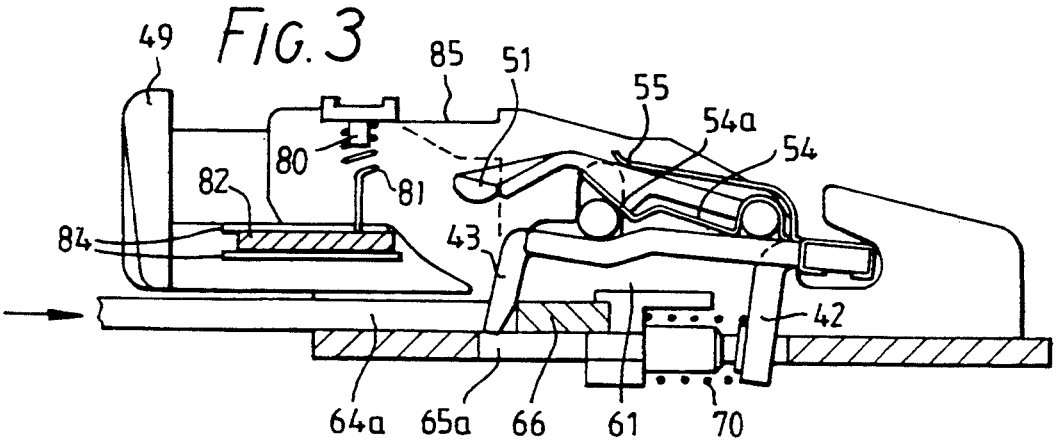

FIG. 3 illustrates the initial action of the buckle mechanism upon insertion of the tongue. The tongue engages face 66a of the ejector 66, compressing ejector spring 70 further against the downward projection 42 of the lock plate 46, thereby now increasingly urging the lock plate with its projection 43 towards the tongue 64a. The lock plate carries with it the pin 62 which is therefore tends to be moved towards the part 63a of the L-shaped cut-out, which is parallel to the direction of entry of the tongue. The projection 43 of lock plate 46 now engages the surface of the tongue 64 and as soon as the projection 43 of the locking plate is aligned for free entry into the aperture 64a, locking occurs and pin 62 moves into parts 63b of the L-shaped slots, where it is held in place by the surface 47a of rocker 47. The action is shown in FIGS. 3 and 4.

Referring further to FIG. 4, the action of plate 82 may now be considered. Assuming that the buckle is connected to the body of a vehicle at its right hand end via an anchorage which includes means for pretensioning the seat belt in the event of crash conditions occurring the slideable plate 8 may be temporarily deflected to the position shown upon completion of the pretensioning action. In other words after rapid rightwards acceleration on firing of the pretensioning means, an impulsive deceleration causes deflection of plate 82 before similar inertial action on the button 49 can otherwise cause the button with its cam surfaces 49a to act in a releasing manner (as described below relative to FIG. 5) on the ears 51 of member 47. Accordingly, spurious release action on the buckle tongue due to button inertia is prevented at such critical times.

Figure 6:
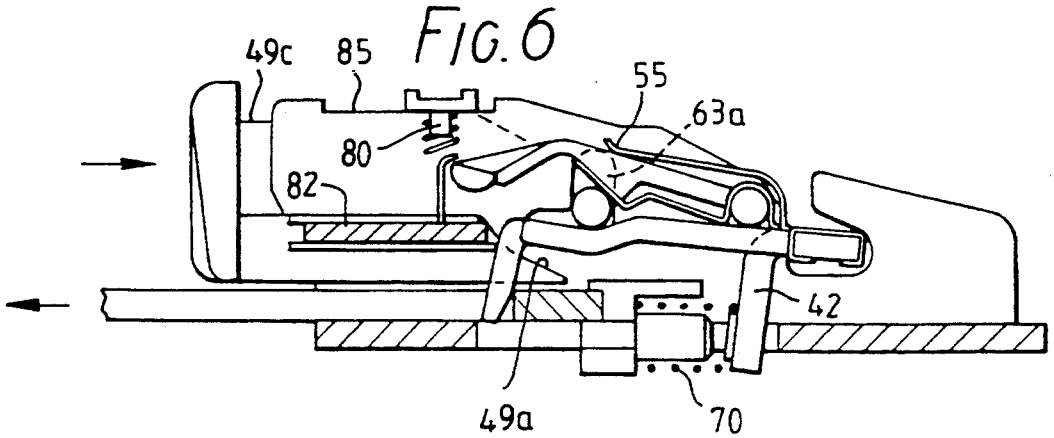

Considering now the normal release action of the buckle, when the button 49 is depressed as shown in FIG. 6 against springs 49c, the lateral projections 51 of the rocker 47 are engaged by ramps 49a, whereby the rocker is lifted out of engagement with the pin 62 and pin 62 is then abutted by faces 49b of the button, urging it against the action of spring leaves 54 towards the limbs 63b of the L-shaped slots. Thus as shown in FIG. 6, the locking plate 46 is able to be moved pivotally about 59 assisted by possible engagement with ramps 49a of the button and carrying pin 62 with it, releasing tongue 64 and ejecting it by virtue of the force of spring 70. Following such release the buckle then rests in the state shown in FIG. 2.

Changes and modifications in the above described embodiment of the invention can, of course be carried out without departing from the scope thereof.

I claim:

1. A seat belt buckle mechanism which comprises a generally U-shaped frame presenting an opening at one end for receiving a tongue along a path between two side portions and generally parallel to a base portion, said tongue being engageable with a spring-loaded ejector, a locking element having means at one end engaging the side portions to be tiltable therebetween whereby a projection of said element is movable into or out of locking relationship with said tongue and a retaining member movable into or out of a locking position wherein it prevents movement of the projection away from said locking relationship and said retaining member being movable by the action of a release member to permit release of the tongue, the mechanism including inertial protection means operable to inhibit the action of the release member in the event of predetermined excessive rate of change of speed of the buckle in a direction tending to cause spurious release by the release member.

2. A seat belt buckle mechanism comprising a generally U-shaped frame presenting an opening at one end for receiving a tongue along a path between two side portions and generally parallel to a base portion, said tongue being engageable with a spring-loaded ejector, a locking element tiltably supported in the frame whereby a projection of said element is movable into or out of locking relationship with said tongue and a retaining member movable into or out of a locking position wherein it prevents movement of the projection away from said locking relationship and said retaining member being movable by the action of a release member to permit release of the tongue, the mechanism including inertial protection means slidingly movable from a first position to a second position, in response to a predetermined acceleration or deceleration, for inhibiting unlocking of the locking element.

3. A seat belt buckle as claimed in claim 2 wherein said protection means comprises an inertial part and means normally resiliently retaining it in a predetermined position within the U-shaped frame, said part being inertially responsive to a predetermined rate of change of speed of the frame to move into an abutting position to prevent movement of the locking element from said locking relationship.

4. A seat belt buckle mechanism as claimed in claim 3, wherein said resiliently retaining means comprises a fine helical spring the ends of which are supported whereby its resilience permits relative movement of the ends transversely to the helix axis.

5. A seat belt buckle mechanism as claimed in claim 4 wherein said part of the protection means comprises a part resiliently movably carried by the release member, the resilient means thereof permitting movement of the said part to said abutting position in the frame before movement of the release member 20.

6. A seat belt buckle mechanism as claimed in claim 4, including a pivotable rocking member which normally acts to maintain the locking element in said locking relationship, the abutting position of said part being an abutting position relative to said pivotable rocking member.

7. A seat belt buckle mechanism as claimed in claim 3 wherein said part of the protection means comprises part resiliently movably carried by the release member, the resilient means thereof permitting movement of the said part to said abutting position in the frame before movement of the release member 20.

8. A seat belt buckle mechanism as claimed in claim 7, including pivotable rocking member which normally acts to maintain the locking element in said locking relationship, the abutting position of said part being an abutting position relative to said pivotable rocking member.

9. A seat belt buckle mechanism as claimed in claim 7 wherein said part comprises a plate like part slidingly carried by rails of said release member.

10. A seat belt buckle mechanism as claimed in claim 9, including a pivotable rocking member which normally acts to maintain the locking element in said locking relationship, the abutting position of said part being an abutting position relative to said pivotable rocking member.

11. A seat belt buckle mechanism as claimed in claim 3 including a pivotable rocking member which normally acts to maintain the locking element in said locking relationship, the abutting position of said part being an abutting position relative to said pivotable rocking member.

* * * * *